US006416277B1

(12) United States Patent
Manges, Jr.

(10) Patent No.: US 6,416,277 B1
(45) Date of Patent: Jul. 9, 2002

(54) INDIVIDUALLY REPLACEABLE AND REVERSIBLE INSERTABLE STEAM TURBINE NOZZLE

(75) Inventor: William E. Manges, Jr., White Oaks, PA (US)

(73) Assignee: Elliott Turbomachinery Co., Inc., Jeannette, PA (US)

( * ) Notice: Subject to any disclaimer, the term of this patent is extended or adjusted under 35 U.S.C. 154(b) by 0 days.

(21) Appl. No.: 09/581,495

(22) Filed: Jun. 14, 2000

Related U.S. Application Data

(60) Provisional application No. 60/107,160, filed on Nov. 5, 1998.

(51) Int. Cl.[7] ..... F01D 9/02

(52) U.S. Cl. ..... 415/189; 415/202; 415/209.2; 415/209.3; 415/911; 29/401.1; 29/889.22; 239/391; 239/392; 239/395

(58) Field of Search ..... 415/183, 185, 415/189, 190, 202, 209.2, 209.3, 911, 912; 29/401.1, 889.22; 239/391, 392, 395

(56) References Cited

U.S. PATENT DOCUMENTS

| | | | |
|---|---|---|---|
| 1,750,652 | A | 3/1930 | Waller |
| 3,758,229 | A | 9/1973 | Price et al. |
| 4,066,381 | A | 1/1978 | Earnest |
| 4,097,188 | A | 6/1978 | Forster |
| 5,259,727 | A | 11/1993 | Quinn |
| 5,392,513 | A | 2/1995 | Mazzola et al. |
| 5,522,695 | A | 6/1996 | Franetzki et al. |

FOREIGN PATENT DOCUMENTS

| | | |
|---|---|---|
| GB | 223973 | 10/1924 |
| GB | 772442 | 4/1957 |

OTHER PUBLICATIONS

International Preliminary Examination Report for PCT Application No. PCT/US99/25827.

*Primary Examiner*—Christopher Verdier
(74) *Attorney, Agent, or Firm*—Webb Ziesenheim Logsdon Orkin & Hanson, P.C.

(57) ABSTRACT

A reversible nozzle (10), removably attached to a fluid emitting base, such as a half turbine casing (22). The reversible nozzle (10) has a nozzle body (16) and a nozzle tube (12), with the nozzle body (16) preferably forming a plurality of fastener receiving slots (18, 18*a*). The nozzle tube (12) is angled with respect to the nozzle body (16). An installed reversible nozzle (10) is reversed by removing fasteners (34) connecting the nozzle body (16) to the fluid emitting base (22), rotating the nozzle body (16) about a normal nozzle body axis X, and resecuring the reversible nozzle (10) to the fluid emitting base (22) with fasteners (34). To aid in the alignment of the reversible nozzle (10), one fastener receiving slot (18*a*) is preferably elongated.

19 Claims, 4 Drawing Sheets

INDIVIDUALLY REPLACEABLE AND REVERSIBLE INSERTABLE STEAM TURBINE NOZZLE

This application claims benefit of U.S. Provisional Application Ser. No. 60/107,160, filed Nov. 5, 1998.

BACKGROUND OF THE INVENTION

1. Field of the Invention

The present invention generally relates to nozzles and, more particularly, to reversible nozzles used in steam turbines.

2. Brief Description of the Prior Art

Nozzles are used in a variety of applications, one of which is directing steam in steam turbines. Steam turbines utilize nozzles to direct high pressure steam or gas toward turbine blades. For example, turbine nozzles are discussed in U.S. Pat. Nos. 1,750,652; 4,066,381; 4,097,188; 5,259,727; and 5,392,513. The high pressure gas exits the nozzles at high velocities and contacts the turbine blades causing the blades to rotate. The nozzles are typically installed in two ways. In one arrangement, a plurality of nozzles is assembled into a nozzle plate or ring and bolted into the turbine. Another arrangement involves drilling the turbine casing and then positioning and welding the nozzles into place.

From time to time, installed nozzles wear and must be removed and replaced. Further, depending on the turbine design, differently oriented nozzles are used to cause the turbine blades to rotate in either a clockwise direction or a counterclockwise direction. If the direction of rotation is to be changed, the nozzle must be removed and realigned. These are all time-consuming and expensive endeavors, especially if the nozzles are welded in place.

Therefore, it is an object of the present invention to provide nozzles which can be installed, removed, or reversed without welding.

SUMMARY OF THE INVENTION

The present invention generally relates to reversible nozzles removably connected to a fluid emitting base, with each nozzle having a nozzle tube and a nozzle body. Each nozzle tube defines a fluid inlet, a fluid exit aperture, and a nozzle passageway connecting the fluid inlet and the exit aperture. Each nozzle body is connected to a first end of a corresponding nozzle tube with each nozzle body forming an internal cavity and a plurality of fastener receiving slots. The nozzle tube extends along a nozzle axis, wherein the nozzle axis intersects a nozzle body axis, forming a nozzle angle between the axes.

In operation, the nozzle body and accompanying nozzle tube are positioned adjacent to a fluid emitting base, preferably with the nozzle tube projecting away from the fluid emitting base. Fluid exiting the fluid emitting base is received through the nozzle body cavity, enters the fluid inlet of the nozzle tube, moves through the nozzle passageway formed by the nozzle tube, and exits through the fluid exit aperture of the nozzle tube.

Each nozzle tube can direct fluid in a plurality of directions. In general, the direction of fluid exiting the fluid exit aperture of each nozzle tube is reversed from a first direction to a second direction by removing fasteners that removably connect each nozzle body and corresponding nozzle tube to the fluid emitting base, reversing the fluid exit aperture of each nozzle tube from a first direction to a second direction by rotating the nozzle body with respect to the fluid emitting base, aligning fastener receiving slots formed by each nozzle body with fastener receiving holes formed by the fluid emitting base, and reinstalling the fasteners through the fastener receiving slots formed by the nozzle body and the fastener receiving holes formed by the fluid emitting base. Removal of the nozzles for maintenance or replacement in similar, except that once the fasteners are removed, the old nozzle is removed, and the new nozzle is installed as indicated above.

These and other advantages of the present invention will be clarified in the Detailed Description of the Preferred Embodiments taken together with the attached drawings in which like reference numerals represent like elements throughout.

DETAILED DESCRIPTION OF THE PREFERRED EMBODIMENTS

Figure 1:
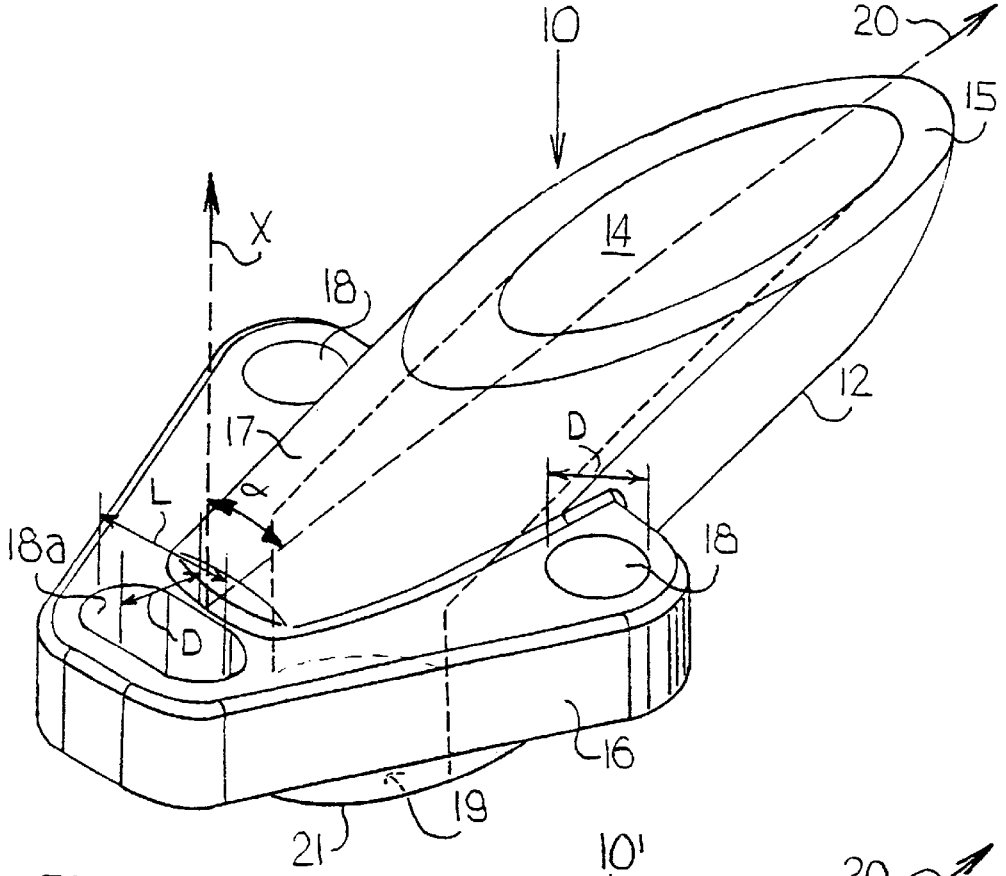
FIG. 1 is a top perspective view of a first embodiment of a reversible nozzle made in accordance with the present invention.

FIG. 1 shows a nozzle 10 made in accordance with the present invention. The nozzle 10 generally includes a nozzle tube 12 and a nozzle body 16, and is preferably made from metal, such as stainless steel.

Figure 2:
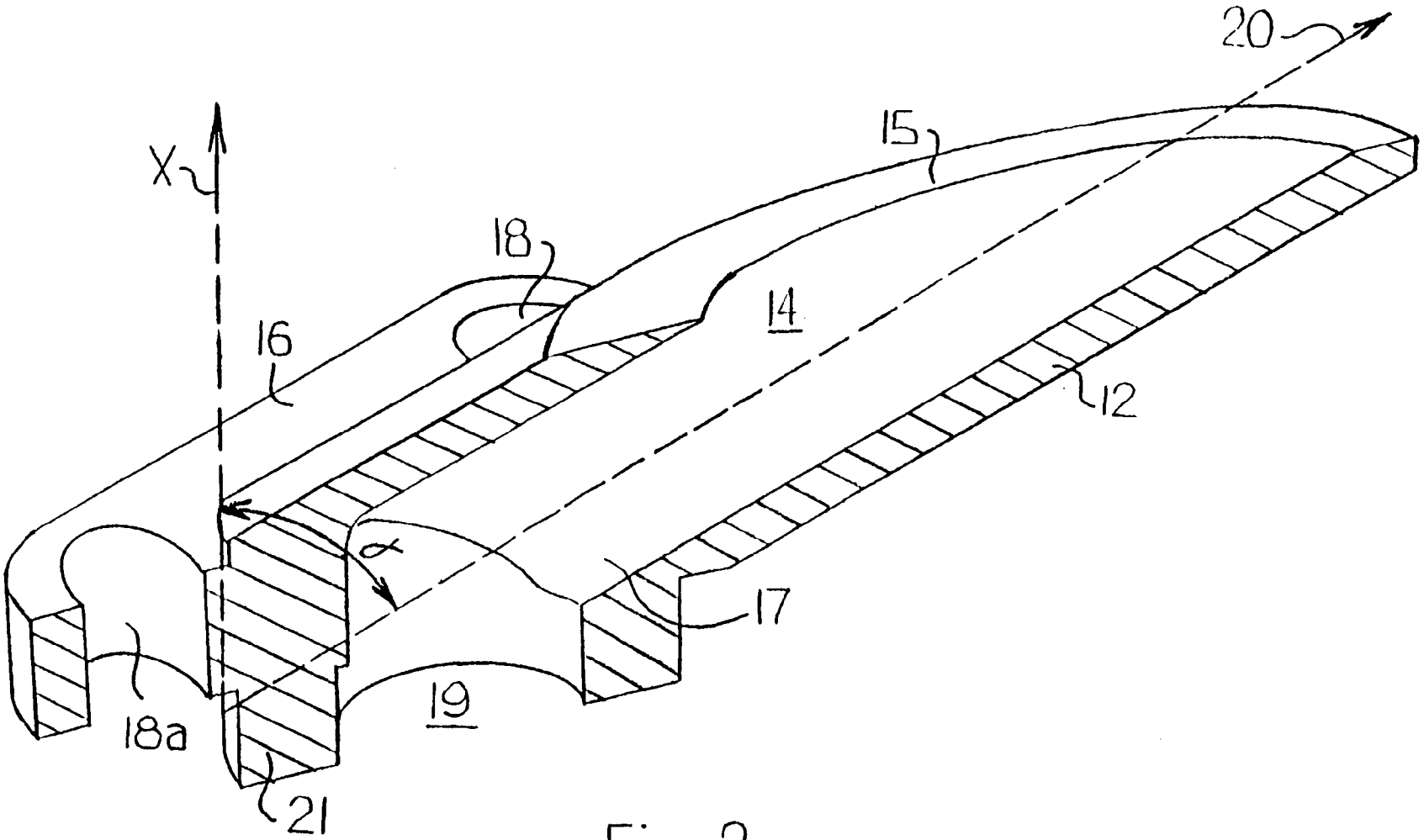
FIG. 2 is a cross-sectional perspective view of the reversible nozzle shown in FIG. 1.

As shown in FIG. 2, the nozzle tube 12 defines a first end 17, a fluid exit aperture 15, and a nozzle passageway 14 connecting the first end 17 and the fluid exit aperture 15. The nozzle tube 12 shown in FIG. 1 is non-cylindrical, allowing the nozzle 10 to be used in applications where higher fluid velocities are desired. The non-cylindrical shape causes divergence of the passing fluid, thereby causing the fluid velocity to increase. It is noted, however, that nozzle tube 12 can assume any suitable configuration or shape.

Figure 4:
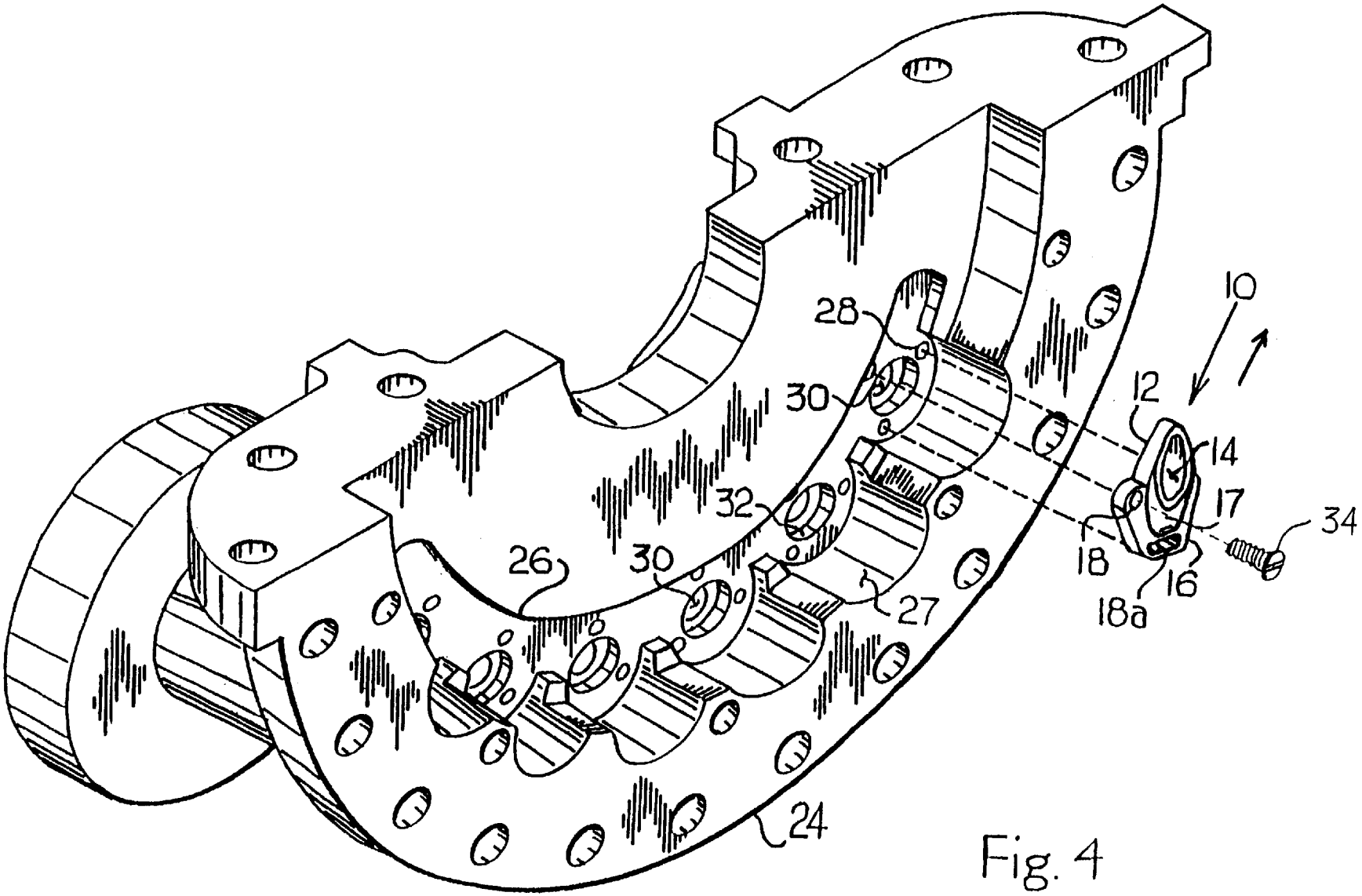
FIG. 4 is an exploded view of the nozzle shown in FIG. 1 and a portion of a turbine casing, with the nozzle in a first orientation.

The nozzle body 16 is connected to the first end 17 of the nozzle tube 12. The nozzle body 16 defines an internal cavity 19 and forms a plurality of fastener receiving slots 18, 18*a* with at least one fastener receiving slot 18*a* having an elongated shape. Slots 18 are circular in shape and are adapted to receive a fastener 34. Slot 18*a* is somewhat elliptical in shape and is adapted to receive the same diameter fastener 34. Preferably, the length L of the elongated slot 18*a* is approximately two times larger than the width D, which is the same as the diameter D of slots 18. The elongated slot 18*a* permits reorienting the nozzle 10 in two directions with only three slots 18, 18*a*, as will be discussed below. In the nozzle 10 shown in FIG. 1, three fastener receiving slots 18, 18*a* are suitably spaced to allow correct positioning of the nozzle body 16 with respect to a fluid emitting base, such as a half turbine casing 22, as shown in FIG. 4, for both clockwise and counterclockwise turbine rotation. The nozzle body 16 further defines a lip 21.

Figure 3:
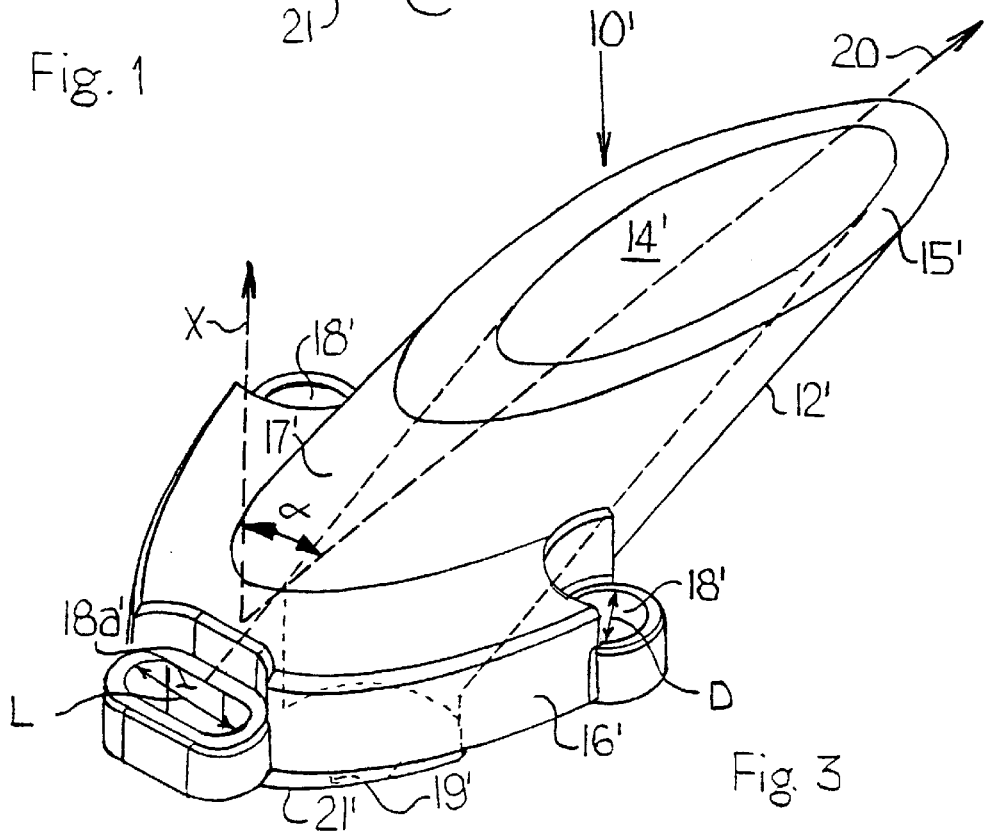
FIG. 3 is a top perspective view of a second embodiment of a reversible nozzle made in accordance with the present invention.

With continuing reference to FIG. 1, the nozzle tube 12 extends along a nozzle axis 20 and intersects a nozzle body axis X, forming an angle α. In FIG. 2, the nozzle axis 20 is shown passing longitudinally through a center of the nozzle tube 12. In FIGS. 1 and 3, the same nozzle axis 20 shown in FIG. 2 is drawn on an exterior surface of the nozzle tube 12 for clarity. However, each of the angles α shown in FIGS. 1–3 are identical to one another in this embodiment.

FIG. 3 shows a second embodiment of a nozzle 10' according to the present invention. The nozzle 10' is similar in external appearance to the nozzle 10 shown in FIGS. 1–2; however, the nozzle 10' in the second embodiment has a nozzle tube 12' that is cylindrical in shape, which is useful in lower velocity applications; moreover, the arrangement of the fastener receiving slots 18', 18*a'* is similar for nozzle 10', but the fastener receiving slots 18', 18*a'* are recessed with respect to the nozzle body 12', thereby allowing the fastener 34 heads, shown in FIG. 4, to sit below a top surface of the nozzle body 16' and not increase the overall size. of the nozzle 10' when the fasteners 34 are installed.

Figure 5:
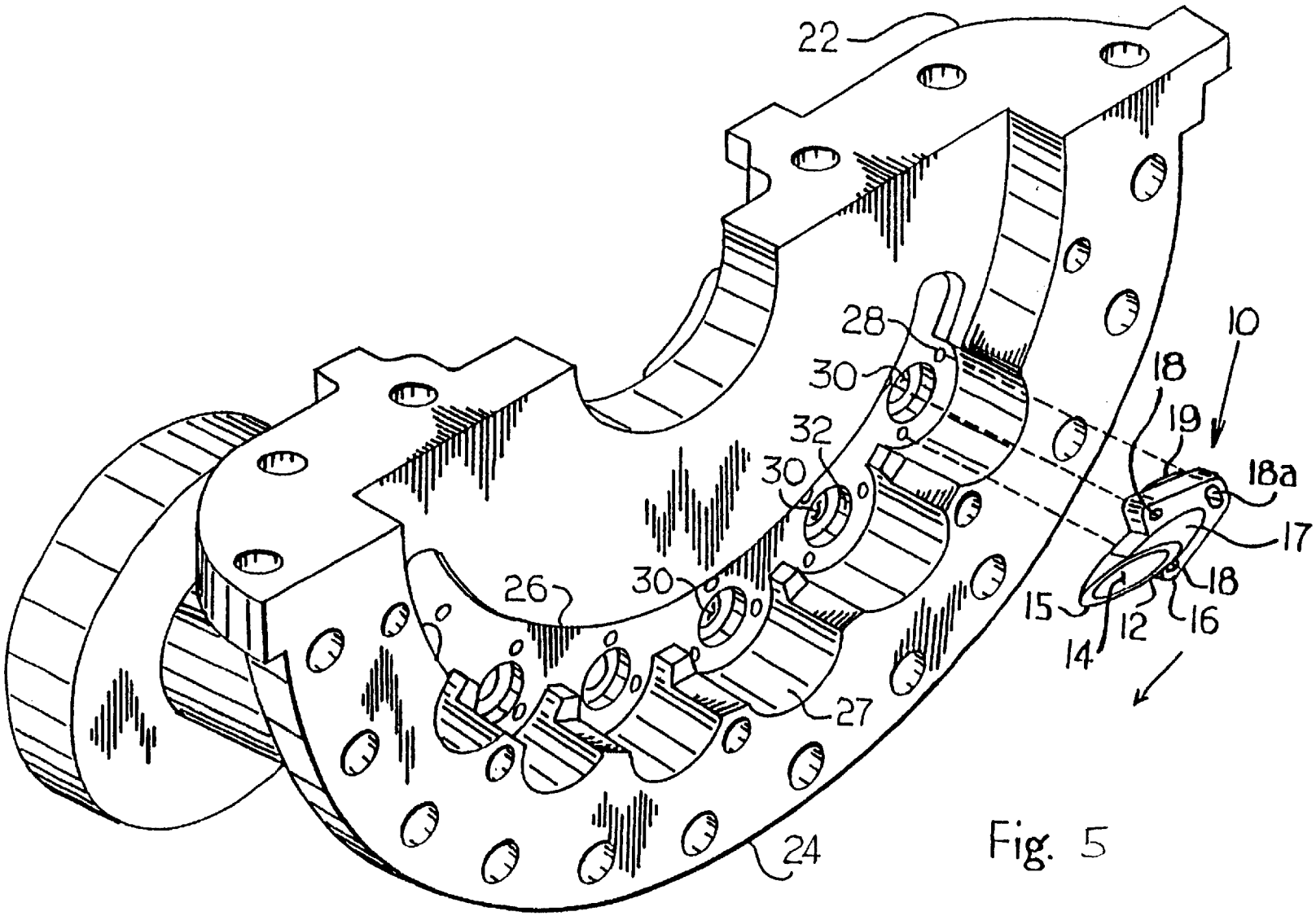
FIG. 5 is an exploded view of the nozzle and turbine casing shown in FIG. 4 with the nozzle in a second orientation.

FIGS. 4–5 show a fluid emitting base, such as a half of a steam end casing 22, that includes an outer flange 24 for receipt of fasteners 34 for connection to a downstream turbine casing. The half turbine casing 22 includes an inner ring 26 machined to receive a plurality of nozzles 10, of which only one is shown. The inner ring 26 includes a plurality of nozzle receiving recesses 27 and a plurality of threaded fastener receiving holes 28. The fastener receiving holes 28 are adapted to align with respective fastener receiving slots 18, 18*a* defined in the nozzle body 16.

A plurality of passageways 30 and lip receiving recesses 32 are defined in the inner ring 26. The nozzle 10 is adapted to be received within the respective nozzle receiving recess 27 so that the fastener receiving holes 28 formed by the nozzle body 16 are aligned with respective fastener receiving slots 18, 18*a*. The lip 21 is received within the lip receiving recess 32 providing a fluid seal. Passageway 30 provides a channel for fluid, such as vaporized water, to exit the half turbine casing 22 and enter the first end 17 of the nozzle tube 12 through fluid inlet 19. Fasteners 34, such as ¼–20 bolts, pass through respective fastener receiving holes 28 and fastener receiving slots 18 for securing and sealing the nozzle 10 to the half turbine casing 22. In this arrangement, all of the nozzle tubes 12 are aligned in a first orientation similar to that shown in FIG. 4, and fluid entering the fluid inlet 19 and exiting the nozzle exit aperture 15 is directed in a first direction, such as a counterclockwise direction, indicated by the arrow. The number of nozzles 10 utilized in a specific turbine is dependent on a number of operating parameters and, therefore, several of the nozzles 10 may not contain passageway 14. These nozzles 10 are known as blanks.

FIG. 5 is similar to FIG. 4 except that each nozzle 10 is rotated an appropriate angle with respect to half turbine casing 22 so that fluid exits the nozzle 10 in a second direction, such as a clockwise direction, as indicated by the arrow. All of the elements in FIG. 5 have the same reference numerals as the elements in FIG. 4.

A method of reversing a direction of fluid flow from a reversible nozzle 10 connected to a fluid emitting base, such as a half turbine casing 22 or a pressure vessel is now described. The same steps apply to each embodiment, but only nozzle 10 will be discussed.

The first step is removing fasteners 34 that removably connect the nozzle 10 to the half turbine casing 22. The next step is reversing the fluid exit aperture 15 of each nozzle tube 12 from a first direction to a second direction by rotating the nozzle body 16 with respect to the half turbine casing 22. The next step is aligning the fastener receiving slots 18, 18*a* formed by said nozzle body 16 with fastener receiving holes 28 formed by the half turbine casing 22. The final step is reinstalling the fasteners 34 through the fastener receiving slots 18, 18*a* formed by the nozzle body 16 and the fastener receiving holes 28 formed by the half turbine casing 22.

The present invention enables the same nozzle 10, 10' to direct a fluid, such as water, steam, or gas, in a plurality of directions by orienting the nozzles 10, 10' with respect to a fluid emitting base. In turbine applications, the present invention eliminates the need for welding nozzles 10, 10' to the half turbine casings 22 and eliminates the need for different nozzles 10, 10' to direct fluid in different directions. Further, the present invention eliminates the need of removing worn nozzles 10, 10' by machining the half turbine casing 22 because of welded nozzles 10, 10'. The present invention permits quick removal of the nozzles 10, 10' for either repair or change in orientation, by removing the appropriate fasteners 34 and securing the nozzles 10, 10' to the half turbine casing 22. Furthermore, the nozzle tube 12, 12' is available in a plurality of converging/diverging passageways 14 to optimize the nozzle 10, 10' efficiency for the specified turbine operating conditions. Finally, the present invention eliminates the need to carry different oriented nozzles 10, 10' in inventory.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A reversible nozzle comprising:

a nozzle tube defining a first end, a fluid inlet, a fluid exit aperture, and a nozzle passageway connecting said fluid inlet and said fluid exit aperture; and a nozzle body connected to said first end of said nozzle tube, said nozzle body defining an internal cavity and forming a plurality of fastener receiving slots;

wherein said nozzle tube extends along a nozzle axis and intersects a nozzle body axis, forming a nozzle angle, and a direction of a fluid exiting said fluid exit aperture of said nozzle tube is reversed from a first direction to a second direction by rotating said nozzle body with respect to a fluid emitting base.

2. The reversible nozzle as claimed in claim 1 wherein said nozzle tube and nozzle body are made from stainless steel.

3. The reversible nozzle as claimed in claim 1 wherein said nozzle tube is cylindrical.

4. The reversible nozzle as claimed in claim 1 wherein said fastener receiving slots are recessed with respect to said nozzle body.

5. The reversible nozzle as claimed in claim 1 wherein one fastener receiving slot is elongated.

6. The reversible nozzle as claimed in claim 4 wherein one fastener receiving slot is elongated.

7. The reversible nozzle as claimed in claim 1 wherein said fluid emitting base is a half turbine casing.

8. A method of reversing a direction of fluid flow from a reversible nozzle connected to a fluid emitting base, said reversible nozzle including a nozzle tube defining a fluid inlet, a fluid exit aperture, and a nozzle passageway connecting said fluid inlet and said fluid exit aperture and a nozzle body connected to said fluid inlet of said nozzle tube, said nozzle body defining a cavity and forming a plurality of fastener receiving slots, wherein said nozzle tube extends along a nozzle axis and intersects a nozzle body axis, forming a nozzle angle, comprising the steps of:

a) removing fasteners that removably connect said nozzle to the fluid emitting base;

b) reversing said fluid exit aperture of said nozzle tube from a first direction to a second direction by rotating said nozzle body with respect to said fluid emitting base;

c) aligning said fastener receiving slots formed by said nozzle body with fastener receiving holes formed by said fluid emitting base; and d) reinstalling said fasteners through said fastener receiving slots formed by said nozzle body and said fastener receiving holes formed by the fluid emitting base.

9. An apparatus for turning turbine blades comprising:

a pressure vessel forming a plurality of passageways and a plurality of fastener receiving holes positioned adjacent nozzle receiving recesses;

a nozzle tube defining a first end, a fluid inlet, a fluid exit aperture, and a nozzle passageway connecting said fluid inlet and said fluid exit aperture; and a nozzle body connected to said first end of said nozzle tube, said nozzle body defining an internal cavity and forming a plurality of fastener receiving slots, said nozzle tube extending along a nozzle axis and intersecting a nozzle body axis, forming a nozzle angle;

said nozzle tube and said nozzle body forming a nozzle;

wherein said pressure vessel receives a plurality of said nozzles, said fastener receiving holes are aligned with fastener receiving slots of a corresponding said nozzle body, and said fasteners pass through said respective fastener receiving holes and fastener receiving slots for securing said respective nozzle to said pressure vessel.

10. The apparatus for turning turbine blades as claimed in claim 9 wherein said nozzle body and said nozzle tube are made from stainless steel.

11. The apparatus for turning turbine blades as claimed in claim 9 wherein said nozzle body further forms a lip positioned adjacent said internal cavity, said lip is positioned in a corresponding lip receiving recess of said pressure vessel.

12. The apparatus for turning turbine blades as claimed in claim 9 wherein said fastener receiving slots are recessed with respect to said nozzle body.

13. The apparatus for turning turbine blades as claimed in claim 9 wherein one fastener receiving slot is elongated.

14. The apparatus for turning turbine blades as claimed in claim 12 wherein one fastener receiving slot is elongated.

15. The apparatus for turning turbine blades as claimed in claim 9 wherein said pressure vessel is a turbine casing.

16. The reversible nozzle as claimed in claim 9 wherein the apparatus is adapted to permit steam to exit said passageways of said pressure vessel and further exit a corresponding said fluid exit aperture of a corresponding said nozzle tube.

17. The apparatus for turning turbine blades as claimed in claim 9 wherein a said reversible nozzles are fitted in said nozzle receiving recesses.

18. The apparatus for turning turbine blades as claimed in claim 9 wherein said nozzle body forms two circular-shaped fastener receiving slots and one elongated fastner receiving slot.

19. The apparatus for turning turbine blades as claimed in claim 18 wherein said circular-shaped fastener receiving slots are opposed to one another and said elongated first receiving slot is positioned between said opposed circular-shaped fastener receiving slots.

* * * * *

UNITED STATES PATENT AND TRADEMARK OFFICE

CERTIFICATE OF CORRECTION

PATENT NO. : 6,416,277 B1
DATED : July 9, 2002
INVENTOR(S) : William E. Manges, Jr.

It is certified that error appears in the above-identified patent and that said Letters Patent is hereby corrected as shown below:

Title page,
Item [22], PCT filed, insert -- Nov. 3, 1999 --.
Item [86], PCT No.:, insert -- PCT/US99/25827 §371(c)(1), (2), (4) Date: June 14, 2000 --.
Item [87], PCT Pub. No.:, insert -- WO00/28189 PCT Pub. Date: May 18, 2000 --.

Column 3,
Line 17, after "size" delete " .".

Signed and Sealed this

Fifth Day of November, 2002

*Attest:*

*Attesting Officer*

JAMES E. ROGAN
*Director of the United States Patent and Trademark Office*